US011125430B1

(12) United States Patent
Wu

(10) Patent No.: US 11,125,430 B1
(45) Date of Patent: Sep. 21, 2021

(54) LED LIGHT AND A PRODUCTION METHOD THEREOF

(71) Applicant: Jinjiang Wonderful Photoelectronic Lighting Co., Ltd., Fujian (CN)

(72) Inventor: Qingbiao Wu, Fujian (CN)

( * ) Notice: Subject to any disclaimer, the term of this patent is extended or adjusted under 35 U.S.C. 154(b) by 0 days.

(21) Appl. No.: 17/017,714

(22) Filed: Sep. 11, 2020

(30) Foreign Application Priority Data

Jun. 22, 2020 (CN) ..... 202010576441.1

(51) Int. Cl.

| | |
|---|---|
| ***F21V 31/00*** | (2006.01) |
| ***F21V 23/00*** | (2015.01) |
| ***F21V 17/12*** | (2006.01) |
| ***F21K 9/238*** | (2016.01) |
| ***F21K 9/90*** | (2016.01) |
| ***F21Y 115/10*** | (2016.01) |
| ***F21K 9/235*** | (2016.01) |
| ***F21K 9/66*** | (2016.01) |

(52) U.S. Cl.
CPC ..... *F21V 31/005* (2013.01); *F21K 9/238* (2016.08); *F21K 9/90* (2013.01); *F21V 17/12* (2013.01); *F21V 23/006* (2013.01); *F21K 9/235* (2016.08); *F21K 9/66* (2016.08); *F21Y 2115/10* (2016.08)

(58) Field of Classification Search
CPC ..... F21V 17/12
See application file for complete search history.

(56) References Cited

U.S. PATENT DOCUMENTS

| | | | | |
|---|---|---|---|---|
| 9,739,471 | B1 * | 8/2017 | Chen | F21V 31/00 |
| 10,718,470 | B1 * | 7/2020 | Wu | F21K 9/235 |
| 10,753,595 | B1 * | 8/2020 | Wan | F21V 3/02 |
| 2009/0251923 | A1 * | 10/2009 | Yu | F21V 31/005 362/653 |
| 2010/0225220 | A1 * | 9/2010 | Tanaka | F21K 9/233 313/46 |
| 2013/0155695 | A1 * | 6/2013 | Liu | F21V 29/506 362/373 |
| 2013/0301261 | A1 * | 11/2013 | Chou | F21K 9/64 362/235 |
| 2015/0098229 | A1 * | 4/2015 | Tamura | F21V 23/007 362/382 |
| 2016/0102853 | A1 * | 4/2016 | Fedele | H01R 43/205 362/382 |
| 2018/0128447 | A1 * | 5/2018 | Chen | F21V 17/12 |

* cited by examiner

*Primary Examiner* — Alan B Cariaso
(74) *Attorney, Agent, or Firm* — Prakash Nama; Global IP Services, PLLC

(57) ABSTRACT

An LED light including a light shell, a light head, electronic components, and a light source component electrically interconnected with the electronic components; the light shell includes a shell body and a mounting section; the mounting section is inserted into the light head; the light column is fitted into the mounting section by interference fit by pressing the light column into the mounting section in order achieve good sealing effect between the light column and the light shell. The water-proof effect for the light source component and the electronic components is good. Also, a production method of the LED light is provided.

9 Claims, 12 Drawing Sheets

LED LIGHT AND A PRODUCTION METHOD THEREOF

BACKGROUND OF THE INVENTION

The present invention relates to the technical field of lights, and more specifically relates to an LED light and a production method thereof.

Due to social and economic developments and the gradually improving LED technology, LED lights are becoming more widely in use in daily lives. LED lighting apparatus are more frequently used in different outdoor occasions, such as outdoor scenery lighting, environmental lighting and building lighting.

Rain may easily get inside an outdoor LED light causing damages. To solve this problem, the LED lights according to the prior arts usually have sealed packaging, that is, resin material is filled at both sides of a PCB mounted with LED light beads and a circuit board, so that rain cannot directly contact with the LED light beads and the circuit board, thereby achieving water-proof effect. However, the water-proof effect achieved is not very satisfactory. If rain gets inside and damages the circuit board, the entire LED light will become useless.

BRIEF SUMMARY OF THE INVENTION

An object of the present invention is to provide a low-cost LED light having a simple structure and good water-proof effect.

To fulfil the above object, the present invention provides the following technical solutions: An LED light, comprising a light shell and a light head fixedly connected with the light shell, wherein the LED light also comprises electronic components and a light source component electrically interconnected and disposed inside the light shell; the light shell comprises a shell body and a mounting section integrally formed on the shell body; the mounting section is inserted into the light head; the light column is fitted into the mounting section by interference fit; the light column is integrally formed by injection molding.

Preferably, the LED light also comprises a first wire and a second wire; the first wire comprises a first power end that connects with a power source and a first connection end that connects with the light source component; the second wire comprises a second power end that connects with the power source and a second connection end that connects with the light source component.

Preferably, the electronic components comprise a first electronic component and a second electronic component; the first wire is connected with the first electronic component; the second wire is connected with the second electronic component; the first electronic component, the second electronic component, the first wire, and the second wire are seal-packaged integrally into the light column formed by injection molding; part of the first wire, part of the second wire, the entire first electronic component and the entire second electronic component are positioned inside the light column.

Preferably, the electronic components comprise a first electronic component and a second electronic component; the first wire is connected with the first electronic component; the first electronic component, the first wire, and the second wire are seal-packaged integrally into the light column formed by injection molding; part of the first wire, part of the second wire, and the entire first electronic component are positioned inside the light column.

Preferably, the light source component comprises a PCB; the PCB is disposed at one end of the light column; the PCB is provided with at least one LED chip by adhering via adhesive or by welding.

Preferably, an outer side surface of the light column is circumferentially provided with a ring-shape groove; a sealing ring is provided inside the ring-shape groove.

Preferably, the light column has a columnar shape; the light column comprises a first light column and a second light column with one end connected with the first light column; a diameter of the first light column is smaller than a diameter of the second light column; an accommodation space filled with glue is formed between an outer side wall of the first light column and an inner side wall of the mounting section.

Preferably, a free end of the second light column is provided with position fixing blocks; one side of the PCB abuts against the position fixing blocks.

Preferably, the diameter of the second light column gradually reduces along a direction from the first light column to the second light column.

Another object of the present invention is to provide a production method of an LED light. The production method is simple, relatively low-cost, and achieves good water-proof effect.

To fulfill the above object, the present invention provides the following technical solutions:

A production method of the LED light, comprising the following steps:

S1: forming the light shell by injection molding;

S2: seal-packaging the first electronic component, the first wire and the second wire integrally into the light column formed by injection molding; and wherein part of the first wire, part of the second wire and the entire first electronic component are positioned inside the light column;

S3: mounting the LED chip and the second electronic component on corresponding positions of the PCB, and welding the LED chip and the second electronic component on the corresponding positions of the PCB via reflow soldering;

S4: inserting the first connection end of the first wire and the second connection end of the second wire which are part of the first wire and part of the second wire exposed from the light column obtained in step S2 into positions on the PCB indicated as neutral and live respectively; and then soldering the first connection end and the second connection end with the PCB;

S5: observing whether the PCB has clean surfaces, whether welding of the LED chip and the second electronic component on the PCB is complete without any parts of the LED chip and the second electronic component left out without welding to the PCB, and whether soldering of the first connection end and the second connection end with the PCB is sufficient for proper electrical connection; and then using an AC 120V 60 Hz power source and a probe to test whether the LED chip can be lighted up;

S6: aligning the semi-finished product obtained in step S4 with a mounting section of the light shell, and then mounting the semi-finished product obtained in step S6 into the mounting section by press fit;

S7: forming an accommodation space between an outer side wall of the first light column and an inner side wall of the mounting section; applying a predetermined amount of glue into the accommodation space; also applying glue to an outer side wall of the mounting section;

S8: following step S7, bending the first power end of the first wire exposed from the light column along an outer surface of the light shell so that the first power end is positioned closely to a threaded surface of the light shell; and also guiding the second power end of the second wire exposed from the light column out of a pad hole at a top side of the light head; and then screwing the light shell into a threaded portion of the light head according to a predetermined threading direction;

S9: soldering the pad hole at the top side of the light head, wherein a resulting spot of soldering is required to have a shape of a dome with smooth surface without any burrs;

S10: observing an outer appearance of the LED light after the glue is solidified to check for glue leakage, improper thread connection and impurities inside the light shell; and then using the AC 120V 60 Hz power source to test the LED light.

By virtue of the technical solutions provided by the present invention, the present invention has the following beneficial effects:

1. Due to the interference fit between the mounting section and the light column, the light column is press fit into the mounting section of the light shell, thereby achieving good sealing effect between the light column and the light shell. Accordingly, good water-proof effect is achieved for the light source component and the electronic components, and the general water-proof capability of the LED light is also improved.

2. The sealing ring is provided at a periphery of the light column so as to achieve good water-proof effect for the light source component and the electronic components, and to further strengthen the sealing effect between the light column and the light shell, thereby effectively increasing the general water-proof capability of the LED light.

3. Glue is used to fill in the accommodation space so that the general water-proof capability of the LED light is further increased.

4. The production method of the present invention is simple and involves a lower cost.

REFERENCE NUMBERS IN THE FIGURES

Figure 1:
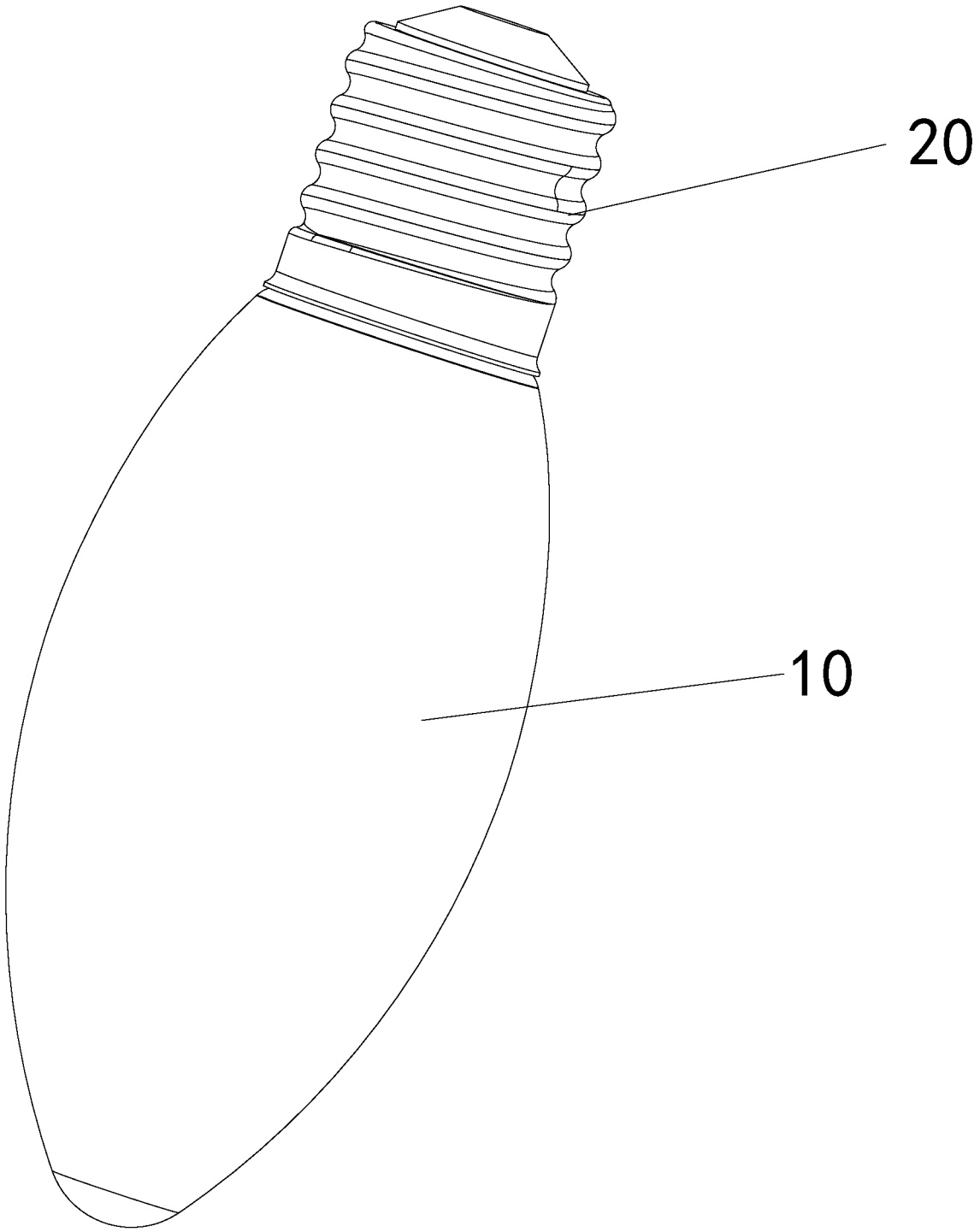
FIG. 1 is a schematic structural view of the present invention according to embodiment 1.

Light shell 10; threaded surface of the light shell 10'; shell body 11; troughs 111; mounting section 12; inner hole 13; light head 20; light column 30; first light column 31; second light column 32; ring-shape groove 33; position fixing blocks 34; accommodation space 35; first electronic component 41; second electronic component 42; PCB 50; first wire 51; first power end 511; first connection end 512; second wire 52; second power end 521; second connection end 522; LED chip 60; glue 70; sealing ring 80.

DETAILED DESCRIPTION OF THE INVENTION

The technical solutions provided by the embodiments of the present invention will be clearly and thoroughly described below with reference to the drawings of the embodiments.

Figure 2:
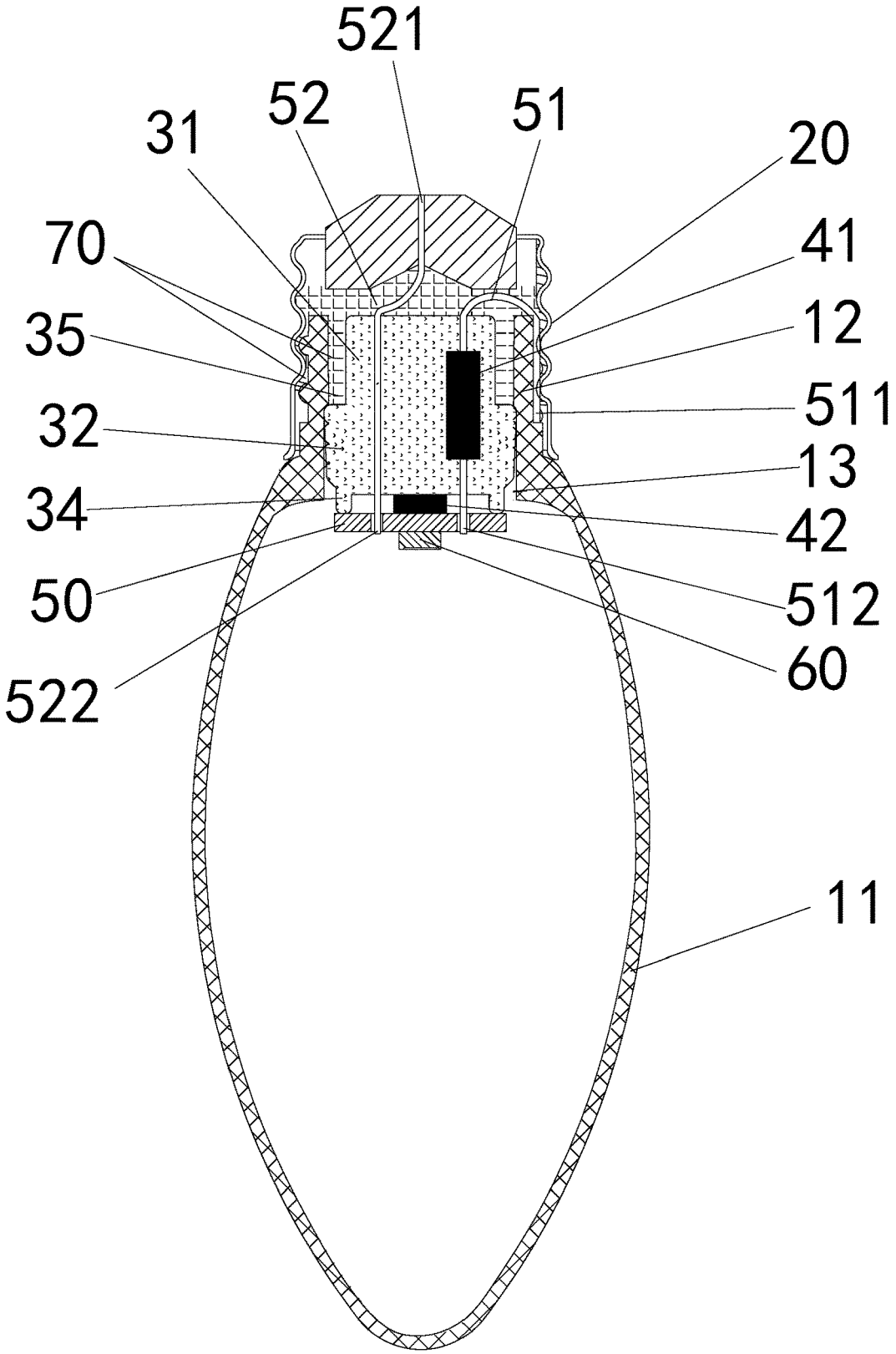
FIG. 2 is a schematic sectional view of the present invention according to embodiment 1.
Figure 3:
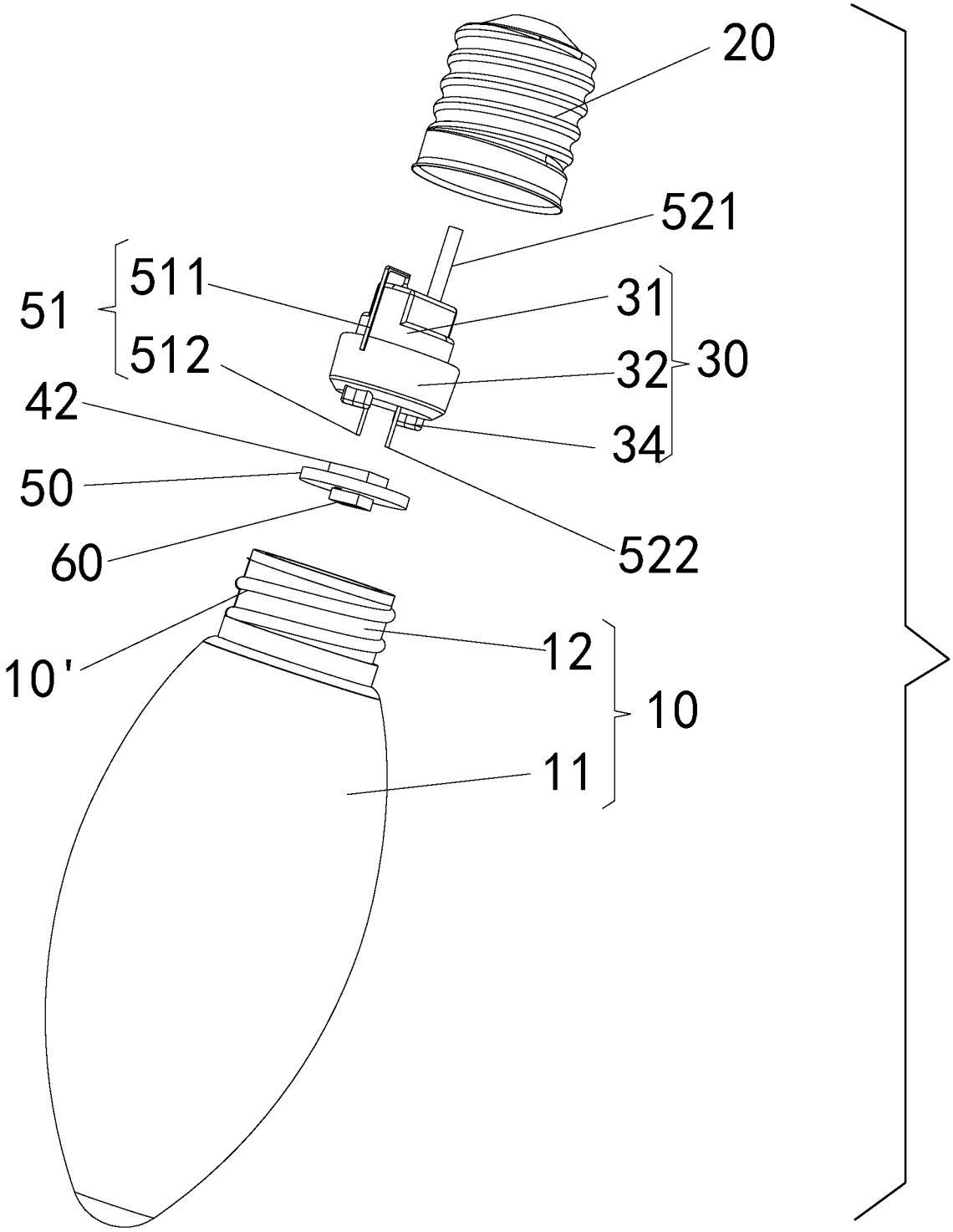
FIG. 3 is a schematic exploded view of the present invention according to embodiment 1.

Embodiment 1 (with Reference to FIGS. 1-3)

The present invention provides an LED light, comprising a first wire 51, a second wire 52, a light shell 10, a light head 20 fixedly connected with the light shell 10, and electronic components and a light source component electrically interconnected and disposed inside the light shell 10. The light shell 10 is a plastic shell that allows light to pass through, and this helps increase the resistance of the LED light upon falling down, and this also prevents the use of open fire during production. The light shell 10 may be formed by integrated blow molding.

The first wire 51 comprises a first power end 511 that connects with a power source, and a first connection end 512 that connects with the light source component. The second wire 52 comprises a second power end 521 that connects with the power source, and a second connection end 522 that connects with the light source component. It should be noted that, the first wire 51 is a neutral wire connected to domestic power, and the second wire 52 is a live wire connected to the domestic power.

The light shell 10 comprises a shell body 11 and a mounting section 12 integrally formed on the shell body 11. The mounting section 12 is inserted into the light head 20. An outer shape of the shell body 11 has the same shape as a light shell of a conventional tungsten light bulb. However, the outer shape of can be varied according to practical needs.

The electronic components comprise a first electronic component 41 and a second electronic component 42; the first wire 51 is connected with the first electronic component 41. The first electronic component 41, the first wire 51, and the second wire 52 are seal-packaged integrally into a light column 30 formed by injection molding. Part of the first wire 51, part of the second wire 52, and the entire first electronic component 41 are positioned inside the light column 30. Specifically, the first power end 511, the first connection end 512, the second power end 521 and the second connection end 522 are exposed from the light column 30. By means of injection molded light column integrally seal-packaged with the first electronic component 41, the first wire 51, and the second wire 52, the first electronic component 41 is entirely positioned inside the light column without any connecting seams. Therefore, good water-proof effect is achieved for the first electronic component 41, thereby improving the general water-proof capability of the LED light.

The mounting section 12 is inserted into the light head 20. The light column 30 is inserted into the mounting section 12 by interference fit to achieve fixed connection between the light column 30 and the mounting section 12.

The mounting section 12 has an inner hole 13 through which an inner cavity of the shell body 11 is in communication with an external environment outside the shell body 11. The light source component is disposed within in the inner hole 13. Preferably, the light source component comprises a PCB 50. A first side of the PCB 50 is provided with at least one LED chip 60 by adhering via adhesive or by welding; a second side of the PCB 50 is provided with the second electronic component 42 by adhering via adhesive or by welding. Of course, the first side of the PCB 50 provided with the LED chip 60 is a side facing towards the shell body 11.

The light column 30 has a columnar shape. The light column 30 comprises a first light column 31 and a second light column 32 connected with the first light column 31. A diameter of the second light column 32 gradually reduces along a direction from the first light column 31 to the second light column 32. The diameter of the second light column 32 at a first end near to the first light column 31 is slightly larger than an inner diameter of the mounting section 12, such that the second light column 32 is fitted into the mounting section 12 by interference fit. The light column 30 is made of plastic material which is flame retarding and fire-proof, and this may improve heat dissipation of the LED light, such that the heat generated by the first electronic component 41 during operation can be dissipated timely, thereby effectively prolonging the service life of the LED light.

A second end of the second light column 32 near to the PCB 50 is provided with position fixing blocks 34. Said second side of the PCB 50 abuts against the position fixing blocks 34 so that the PCB 50 is stably disposed at the light column 30.

A diameter of the first light column 31 is smaller than the diameter of the second light column 32. An accommodation space 35 which can be filled with glue 70 is formed between an outer side wall of the first light column 31 and an inner side wall of the mounting section 12. Use of glue achieves firmer connection, the light shell 10 and the light head 20 may not be easily separated by external force during installation, and the general water-proof capability of the LED light is also effectively increased.

Figure 4:
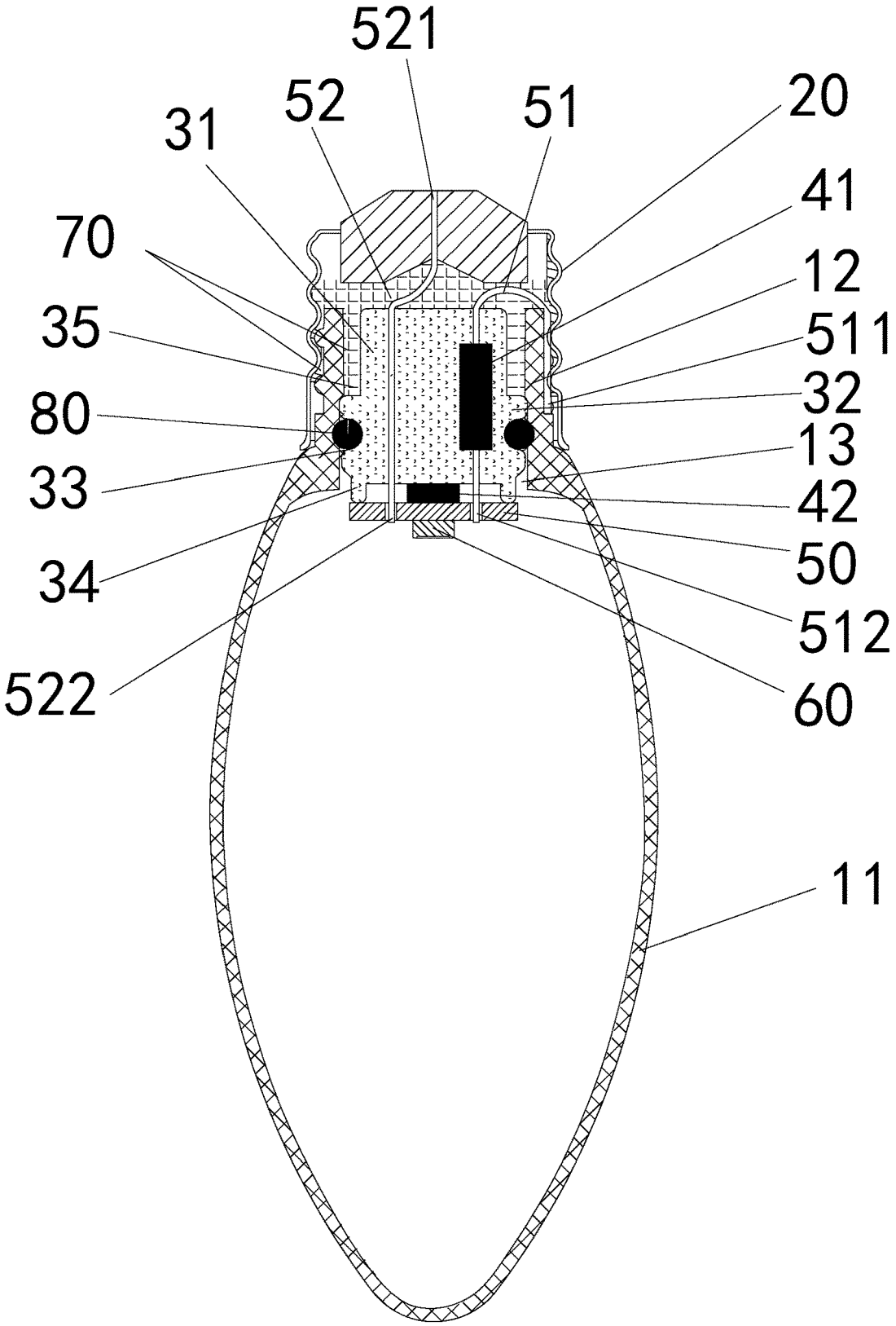
FIG. 4 is a schematic sectional view of the present invention according to embodiment 1 (with a sealing ring).
Figure 5:
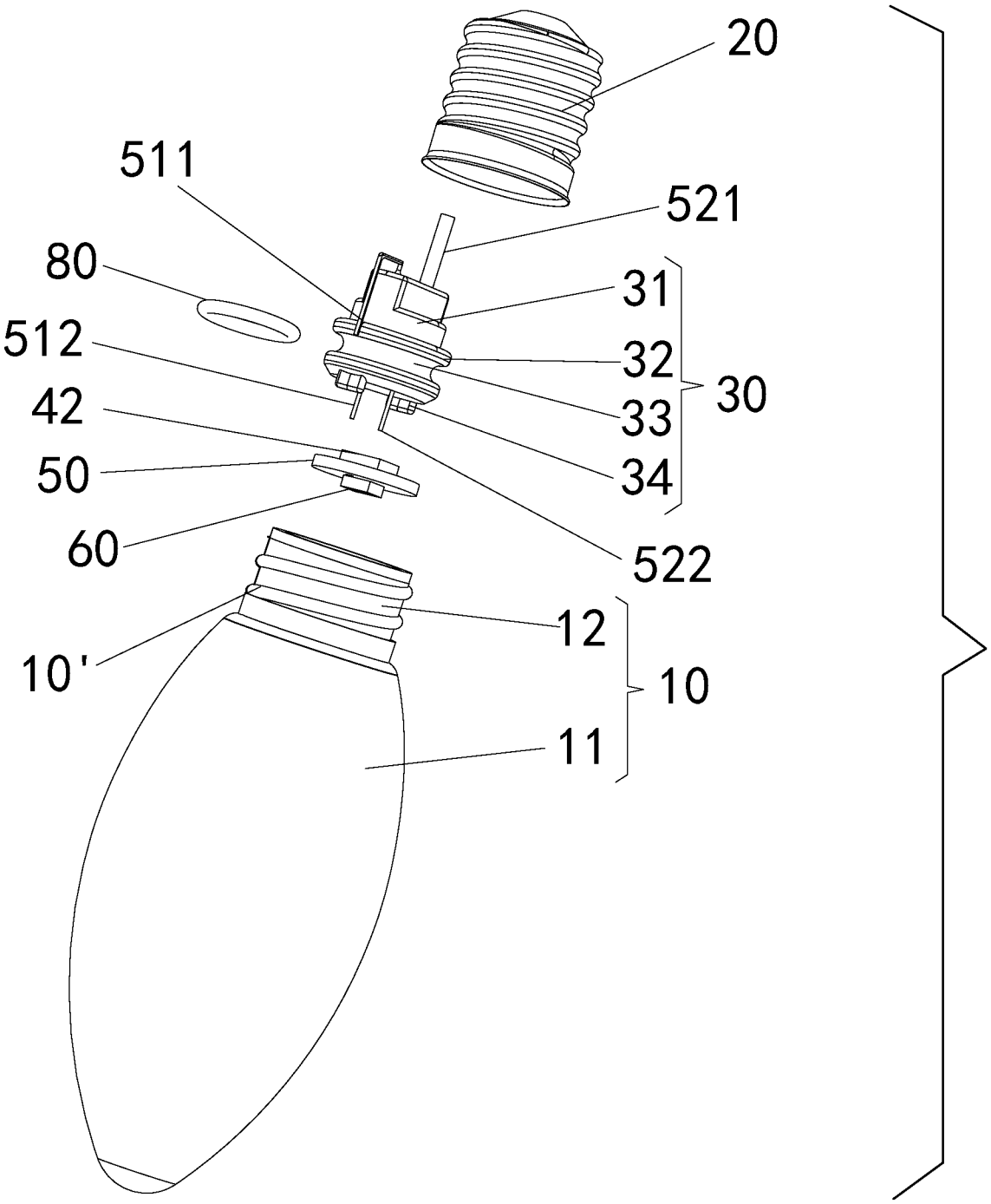
FIG. 5 is a schematic exploded view of the present invention according to embodiment 1 (with a sealing ring).
Figure 6:
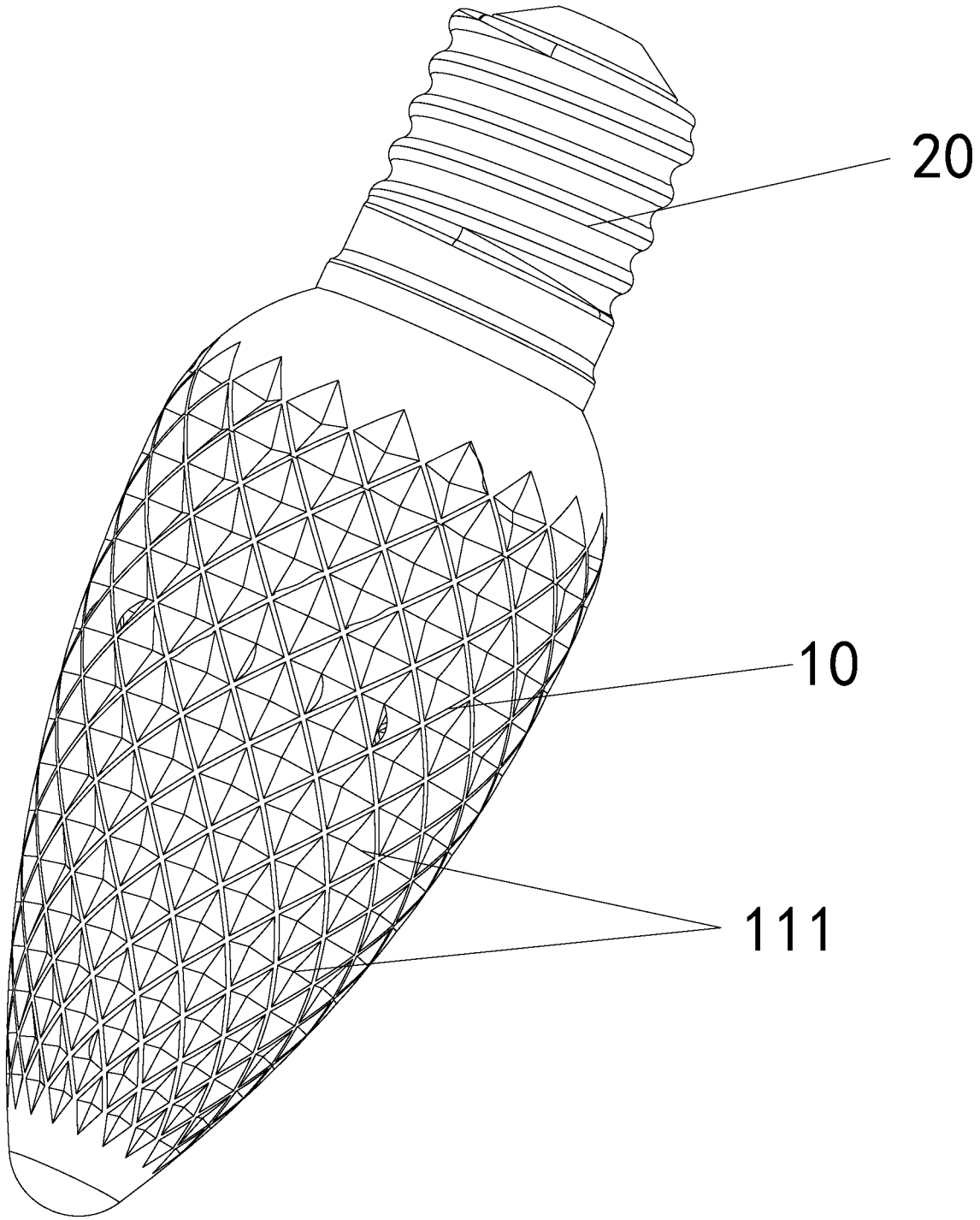
FIG. 6 is a schematic structural view of the present invention according to embodiment 2.
Figure 7:
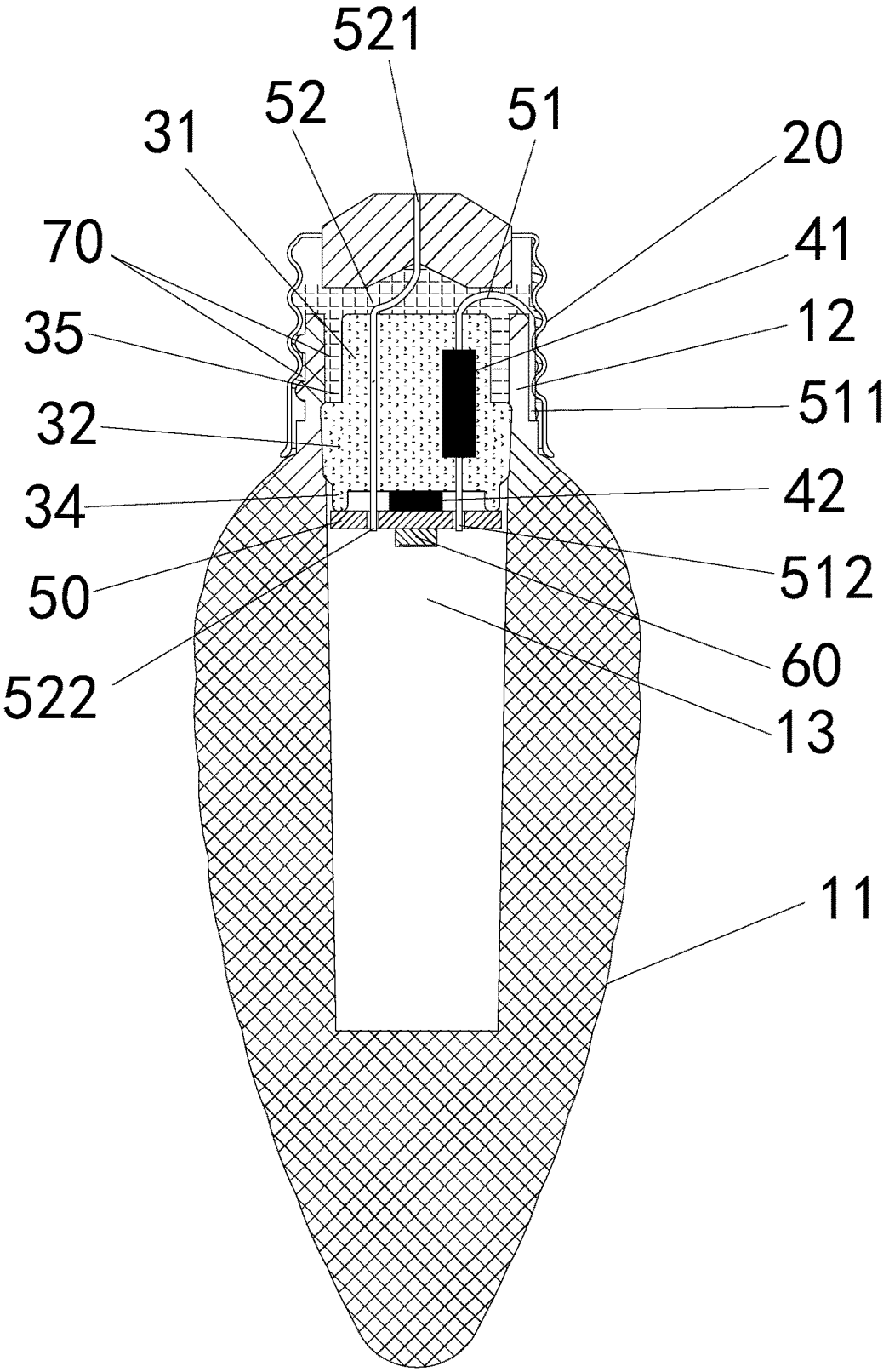
FIG. 7 is a schematic sectional view of the present invention according to embodiment 2.
Figure 8:
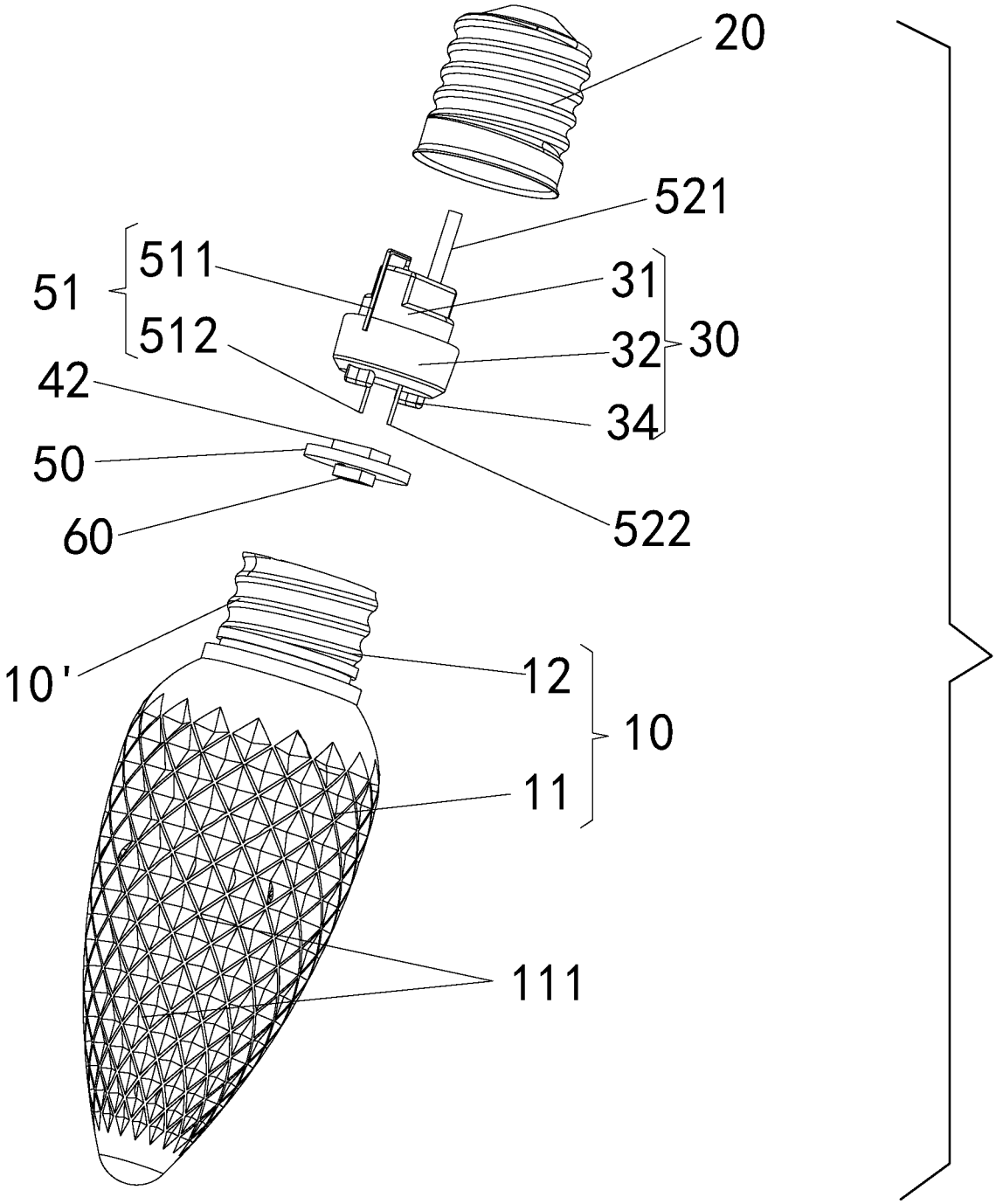
FIG. 8 is a schematic exploded view of the present invention according to embodiment 2.
Figure 9:
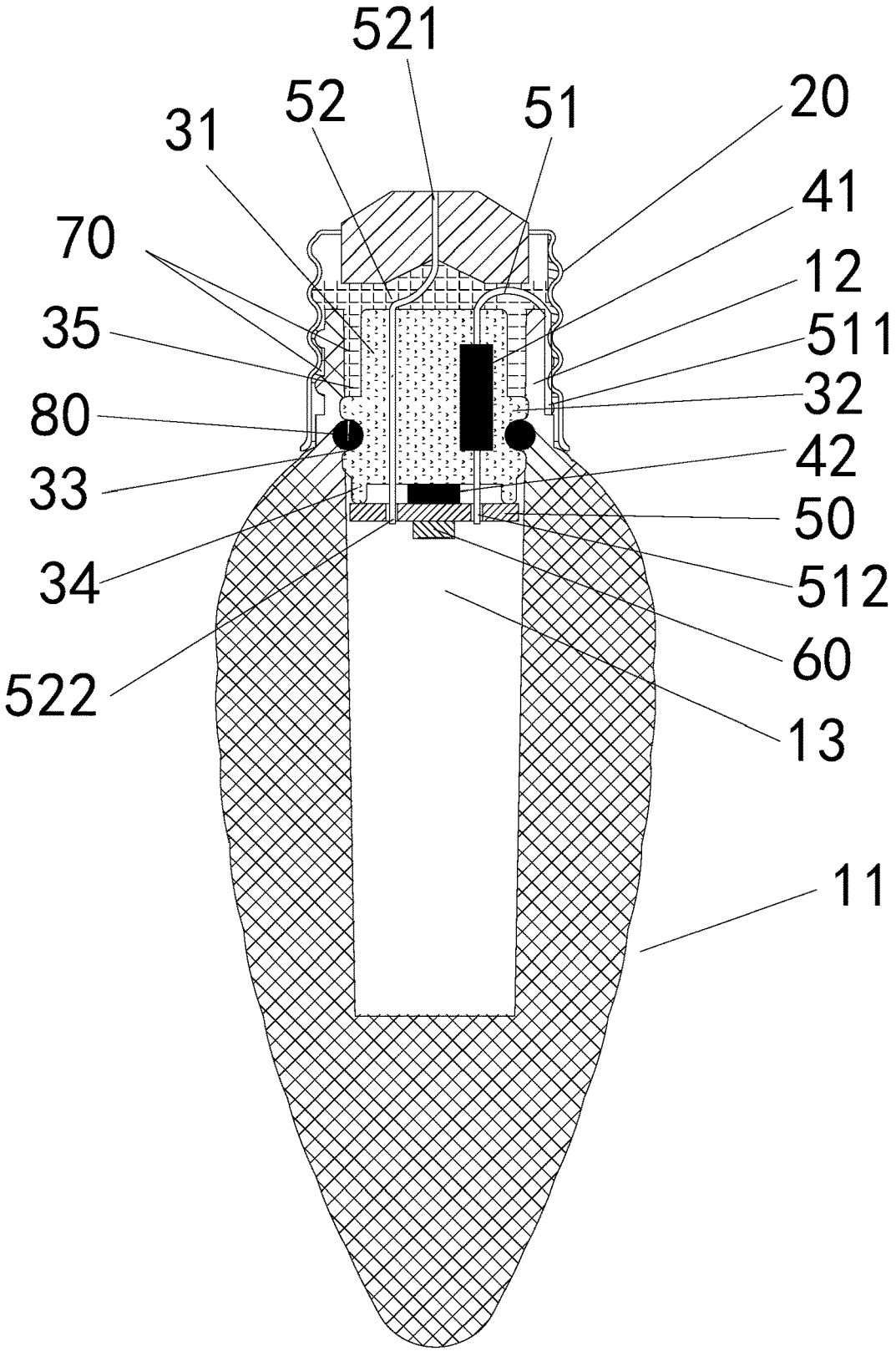
FIG. 9 is a schematic sectional view of the present invention according to embodiment 2 (with a sealing ring).
Figure 10:
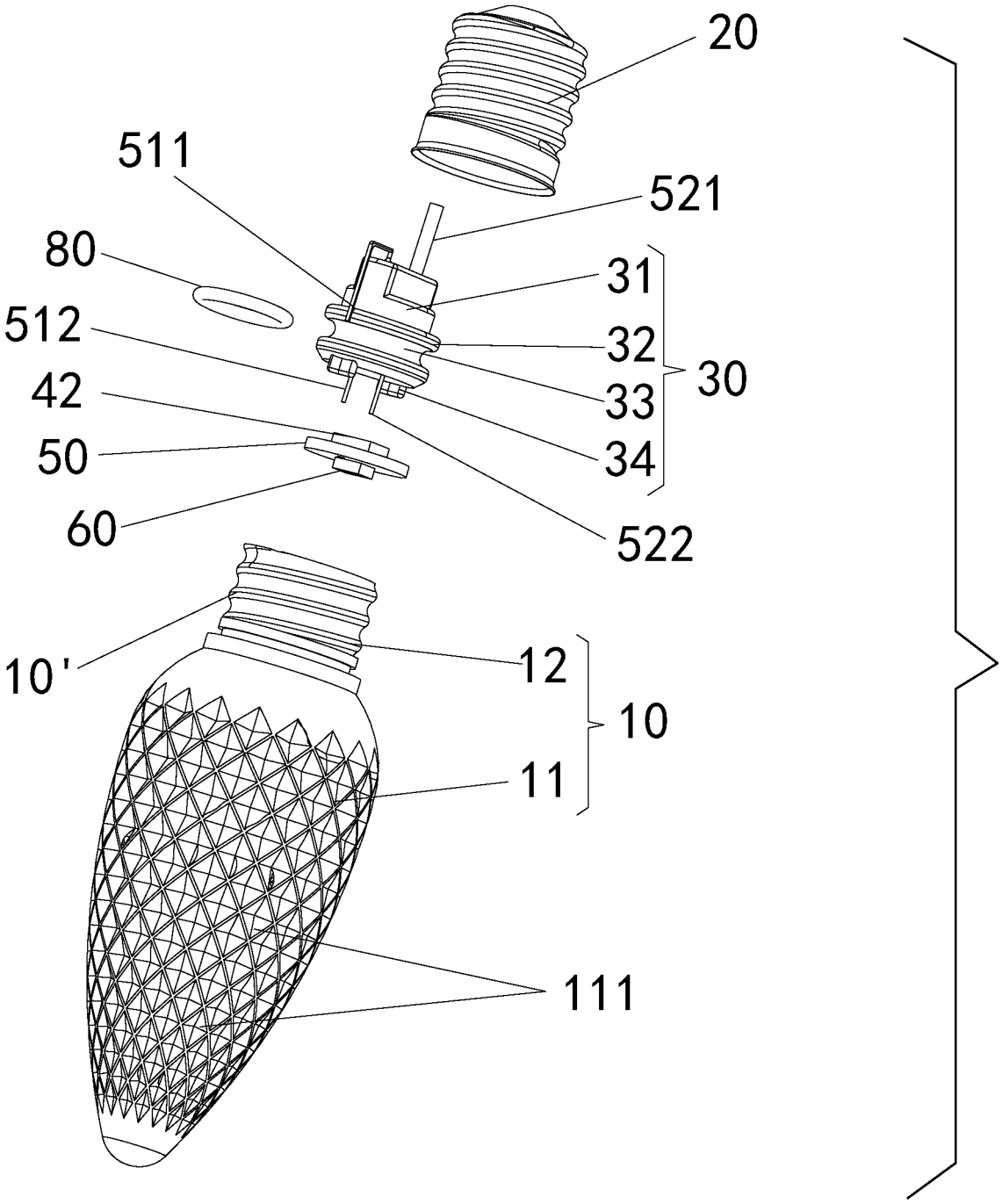
FIG. 10 is a schematic exploded view of the present invention according to embodiment 2 (with a sealing ring).

As shown in FIGS. 4-5, an outer side surface of the second light column 32 is circumferentially provided with a ring-shape groove 33. A sealing ring 80 is provided inside the ring-shape groove 33 so as to further improve the water-proof effect for the LED chip 60 disposed inside the light shell 10 and to further increase the sealing effect between light column 30 and the light shell 10.

The above technical solutions of the present invention have the following beneficial effects:

1. By means of injection molded light column 30 integrally seal-packaged with the first electronic component 41, the first wire 51, and the second wire 52, part of the first wire 51, part of the second wire 52, and the entire first electronic component 41 are entirely positioned inside the light column 30 without any connecting seams. Therefore, good water-proof effect is achieved for the first electronic component 41, thereby improving the general water-proof capability of the LED light.

2. Due to the interference fit between the mounting section 12 and the light column 30, the light column 30 is press fit into the mounting section 12 of the light shell 10, thereby achieving good sealing effect between the light column 30 and the light shell 10. Accordingly, good water-proof effect is achieved for the LED chip 60 disposed inside the light shell 10, and the general water-proof capability of the LED light is also improved.

3. Use of flame retarding and fire-proof material in making the light column 30 facilitates timely dissipation of heat generated by the first electronic component 41, thereby prolonging the service life of the LED light.

4. The sealing ring 80 is provided at a periphery of the second light column 32 so as to achieve good water-proof effect for the LED chip 60 disposed inside the light shell 10, and to further strengthen the sealing effect between the light column 30 and the light shell 10, thereby effectively increasing the general water-proof capability of the LED light.

5. Glue 70 is used to filled in the accommodation space 35 so that the light column 30 and the mounting section 12 will not be easily separated from each other under external force, and the general water-proof capability of the LED light is also further increased.

Embodiment 2 (with Reference to FIGS. 6-10)

Embodiment 2 is different from embodiment 1 in that: an outer surface of the shell body 11 is provided with evenly distributed troughs 111. Therefore, when light rays pass through the shell body 11, the light rays will be reflected to achieve more charming lighting effects. The light shell 10 can be formed by integral injection molding.

Figure 11:
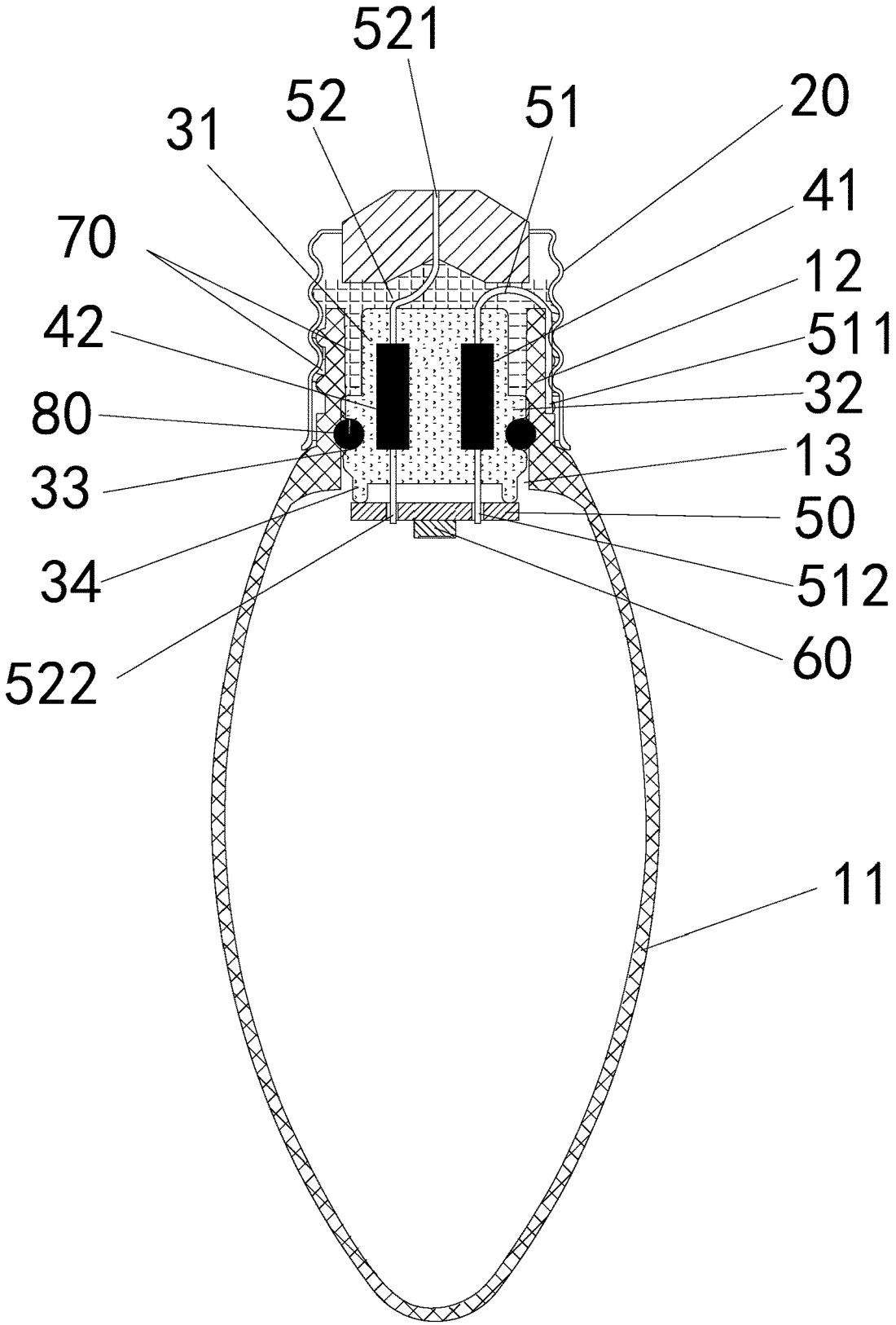
FIG. 11 is a schematic sectional view of the present invention according to embodiment 3 (with a sealing ring).

Embodiment 3 (with Reference to FIG. 11)

Embodiment 3 is different from embodiment 1 in that: the first wire 51, the second wire 52, the first electronic component 41 and the second electronic component 42 are seal-packaged integrally inside the light column 30 formed by injection molding. Part of the first wire, part of the second wire 52, the entire first electronic component 41 and the entire second electronic component 42 are positioned inside the light column 30. Specifically, the first power end 511, the first connection end 512, the second power end 521 and the second connection end 522 are exposed from the light column 30.

Figure 12:
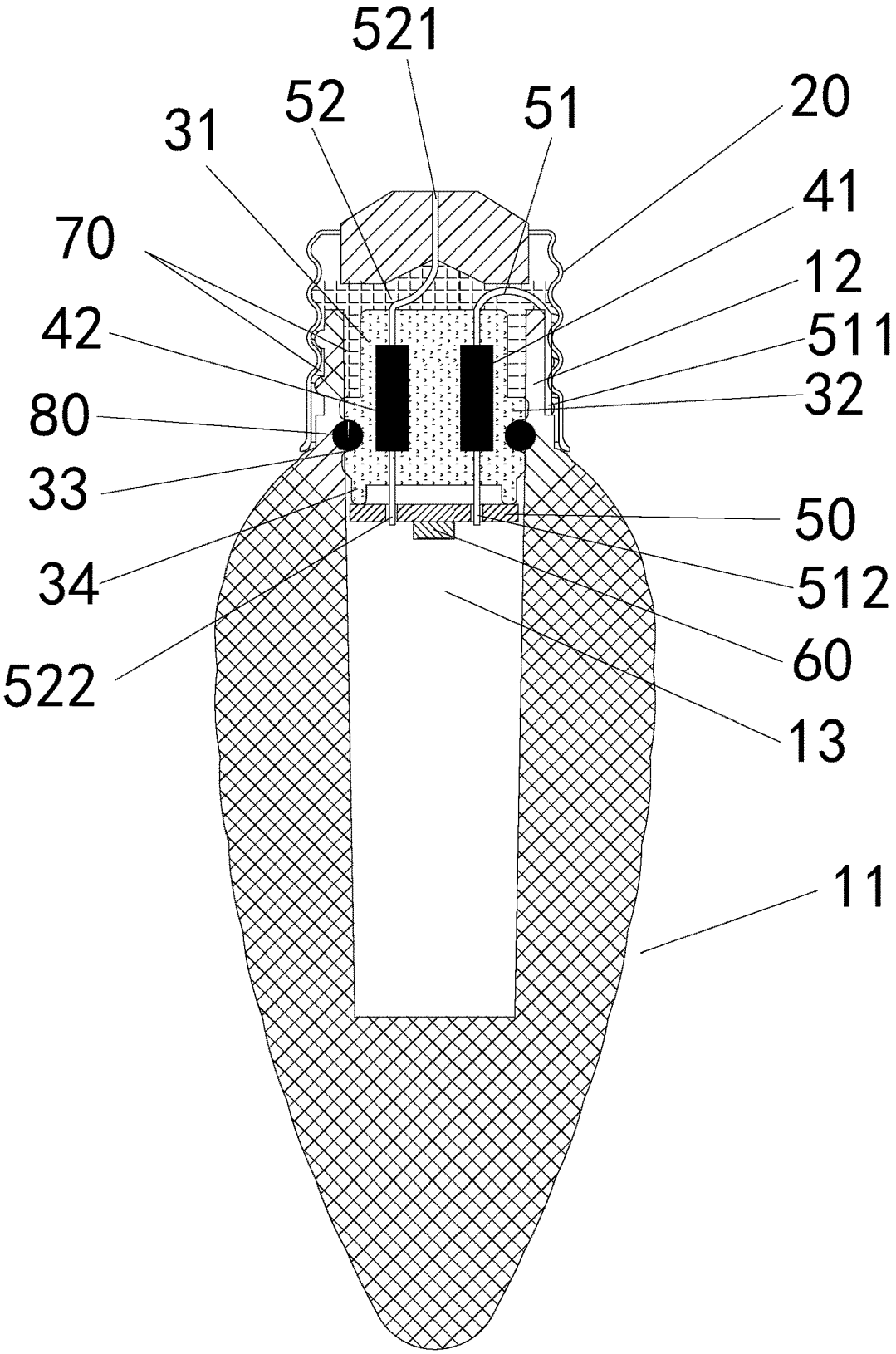
FIG. 12 is a schematic sectional view of the present invention according to embodiment 4 (with a sealing ring).

Embodiment 4 (with Reference to FIG. 12)

Embodiment 4 is different from embodiment 3 in that: an outer surface of the shell body 11 is provided with evenly distributed troughs 111. Therefore, when light rays pass through the shell body 11, the light rays will be reflected to achieve more charming lighting effects. The light shell 10 can be formed by integral injection molding.

The present invention also provides a production method of an LED light, comprising the following steps:

S1: heating up transparent plastic material using an industrial injection molding machine, injecting the plastic material into a mold of the light shell 10 to form the light shell 10 by injection molding;

S2: placing the first electronic component 41, the first wire 51 and the second wire 52 into a second mold for the light column, injecting plastic material into the second mold so that the first electronic component 41, the first wire 51 and the second wire 52 are seal-packaged integrally into a light column 30 formed by the injected plastic material into the second mold, wherein part of the first wire 51, part of the second wire 52 and the entire first electronic component 41 are positioned inside the light column 30;

S3: applying solder paste or red glue on the PCB 50 at positions to be mounted with electronic components, and then using a SMT (surface mount technology) machine (specifically an automatic mounting device) to mount the LED chip 60 and the second electronic component 42 on corresponding positions of the PCB 50, and welding the LED chip 60 and the second electronic component 42 on the corresponding positions of the PCB 50 via reflow soldering;

S4: inserting the first connection end 512 of the first wire 51 and the second connection end 522 of the second wire 52 which are part of the first wire 51 and part of the second wire 51 exposed from the light column 30 obtained in step S2 into positions on the PCB 50 indicated as neutral and live respectively; and then soldering the first connection end 512 and the second connection end 522 with the PCB 50;

S5: observing whether the PCB 50 has clean surfaces, whether welding of the LED chip 60 and the second electronic component 42 on the PCB 50 is complete without any parts of the LED chip and the second electronic component left out without welding to the PCB 50, and whether soldering of the first connection end 512 and the second connection end 522 with the PCB 50 is sufficient for proper electrical connection; and then using an AC 120V 60 Hz power source and a probe to test whether the LED chip can be lighted up;

S6: placing a sealing ring 80 to a ring-shape groove 33 formed around the light column;

S7: aligning the semi-finished product obtained in step S6 with a mounting section 12 of the light shell 10, and then mounting the semi-finished product obtained in step S6 into the mounting section 12 by press fit;

S8: placing the semi-finished product obtained in step S7 on a glue dispensing working platform; aligning a glue dispenser with the accommodation space 35 between the mounting section 12 and the light column 30; applying a proper amount of glue 70 into the accommodation space; also applying glue 70 to an outer side wall of the mounting section 12;

S9: following step S8, bending the first power end 511 of the first wire 51 exposed from the light column 30 along an outer surface of the light shell 10 so that the first power end 511 is positioned closely to a threaded surface 10' of the light shell 10; and also guiding the second power end 521 of the second wire 52 exposed from the light column 30 out of a pad hole at a top side of the light head 20; and then screwing the light shell 10 into a threaded portion of the light head 20 according to a predetermined threading direction;

S10: soldering the pad hole at the top side of the light head 20 by using an electric soldering iron, wherein a resulting spot of soldering is required to have a shape of a dome with smooth surface without any burrs;

S11: observing an outer appearance of the LED light after the glue is solidified to check for glue leakage, improper thread connection and impurities inside the light shell 10; and then using the AC 120V 60 Hz power source to test the LED light.

Although the embodiments of the present invention are described and illustrated, a person skilled in this field of art should understand that, various changes, modifications, replacements and variations of the disclosed embodiments are possible given that they are not deviated from the principles and essence of the present invention. The scope of the present invention is limited by the claims or their equivalents.

What is claimed is:

1. An LED light, comprising a light shell and a light head fixedly connected with the light shell, wherein the LED light also comprises electronic components and a light source component electrically interconnected and disposed inside the light shell; the light shell comprises a shell body and a mounting section integrally formed on the shell body; the mounting section is inserted into the light head; a light column is fitted into the mounting section by interference fit; the light column is integrally formed by injection molding; the light column has a columnar shape; the light column comprises a first light column and a second light column with one end connected with the first light column; a diameter of the first light column is smaller than a diameter of the second light column; an accommodation space filled with glue is formed between an outer side wall of the first light column and an inner side wall of the mounting section.

2. The LED light of claim 1, wherein the LED light also comprises a first wire and a second wire; the first wire comprises a first power end that connects with a power source and a first connection end that connects with the light source component; the second wire comprises a second power end that connects with the power source and a second connection end that connects with the light source component.

3. The LED light of claim 2, wherein the electronic components comprise a first electronic component and a second electronic component; the first wire is connected with the first electronic component; the second wire is connected with the second electronic component; the first electronic component, the second electronic component, the first wire, and the second wire are seal-packaged integrally into the light column formed by injection molding; part of the first wire, part of the second wire, the entire first electronic component and the entire second electronic component are positioned inside the light column.

4. The LED light of claim 2, wherein the electronic components comprise a first electronic component and a second electronic component; the first wire is connected with the first electronic component; the first electronic component, the first wire, and the second wire are seal-packaged integrally into the light column formed by injection molding; part of the first wire, part of the second wire, and the entire first electronic component are positioned inside the light column.

5. A production method of the LED light according to claim 4, wherein the light source component comprises a PCB, and the PCB is provided with at least one LED chip by adhering via adhesive or by welding;

said production method comprises the following steps:

S1: forming the light shell by injection molding;

S2: seal-packaging the first electronic component, the first wire and the second wire integrally into the light column formed by injection molding; wherein injection molding of the light column forms the first light column and the second light column; and wherein part of the first wire, part of the second wire and the entire first electronic component are positioned inside the light column;

S3: mounting the LED chip and the second electronic component on corresponding positions of the PCB, and welding the LED chip and the second electronic component on the corresponding positions of the PCB via reflow soldering;

S4: inserting the first connection end of the first wire and the second connection end of the second wire which are part of the first wire and part of the second wire exposed from the light column obtained in step S2 into positions on the PCB indicated as neutral and live respectively; and then soldering the first connection end and the second connection end with the PCB;

S5: observing whether the PCB has clean surfaces, whether welding of the LED chip and the second electronic component on the PCB is complete without any parts of the LED chip and the second electronic component left out without welding to the PCB, and whether soldering of the first connection end and the second connection end with the PCB is sufficient for proper electrical connection; and then using an AC 120V 60 Hz power source and a probe to test whether the LED chip can be lighted up;

S6: aligning the semi-finished product obtained in step S4 with a mounting section of the light shell, and then mounting the semi-finished product obtained in step S6 into the mounting section by press fit;

S7: forming the accommodation space between the outer side wall of the first light column and the inner side wall of the mounting section; applying a predetermined amount of glue into the accommodation space; also applying glue to an outer side wall of the mounting section;

S8: following step S7, bending the first power end of the first wire exposed from the light column along an outer surface of the light shell so that the first power end is positioned closely to a threaded surface of the light shell; and also guiding the second power end of the second wire exposed from the light column out of a pad hole at a top side of the light head; and then screwing the light shell into a threaded portion of the light head according to a predetermined threading direction;

S9: soldering the pad hole at the top side of the light head, wherein a resulting spot of soldering is required to have a shape of a dome with smooth surface without any burrs;

S10: observing an outer appearance of the LED light after the glue is solidified to check for glue leakage, improper thread connection and impurities inside the light shell; and then using the AC 120V 60 Hz power source to test the LED light.

6. The LED light of claim 1, wherein the light source component comprises a PCB; the PCB is disposed at one end of the light column; the PCB is provided with at least one LED chip by adhering via adhesive or by welding.

7. The LED light of claim 6, wherein a free end of the second light column is provided with position fixing blocks; one side of the PCB abuts against the position fixing blocks.

8. The LED light of claim 1, wherein an outer side surface of the light column is circumferentially provided with a ring-shape groove; a sealing ring is provided inside the ring-shape groove.

9. The LED light of claim 1, wherein the diameter of the second light column gradually reduces along a direction from the first light column to the second light column.

* * * * *